US005986243A

United States Patent [19]

Campf

[11] Patent Number: 5,986,243

[45] **Date of Patent: *Nov. 16, 1999**

[54] OUTDOOR ELECTRIC PERSONAL HEATING SYSTEM

[75] Inventor: Melvin F. Campf, Lake Oswego, Oreg.

[73] Assignee: Thermo Gear, Inc., Tigard, Oreg.

[ * ] Notice: This patent issued on a continued prosecution application filed under 37 CFR 1.53(d), and is subject to the twenty year patent term provisions of 35 U.S.C. 154(a)(2).

[21] Appl. No.: 08/963,100

[22] Filed: Nov. 3, 1997

[51] Int. Cl.[6] ..... H05B 3/34

[52] U.S. Cl. ..... 219/529; 219/211; 219/527

[58] Field of Search ..... 219/529, 549, 219/545, 544, 386, 387, 212, 473, 202, 211; 383/38; 220/553; 320/2

[56] References Cited

U.S. PATENT DOCUMENTS

| | | | |
|---|---|---|---|
| D. 337,473 | 7/1993 | Deandrea . | |
| 2,284,673 | 6/1942 | Munschak | 219/494 |
| 2,993,979 | 7/1961 | Hornsby . | |
| 3,380,087 | 4/1968 | Petty . | |
| 3,427,431 | 2/1969 | Costanzo . | |
| 3,443,066 | 5/1969 | Weibel . | |
| 3,548,147 | 12/1970 | Owers | 219/212 |
| 3,858,028 | 12/1974 | Kerr . | |
| 3,989,924 | 11/1976 | Kurtzer | 219/211 |
| 4,035,606 | 7/1977 | Browder . | |
| 4,070,217 | 1/1978 | Smith, II et al. | 219/212 |
| 4,241,721 | 12/1980 | Holly . | |
| 4,273,989 | 6/1981 | Hinton . | |
| 4,532,410 | 7/1985 | Wehmeyer . | |
| 4,950,868 | 8/1990 | Moss et al. | 219/211 |
| 5,008,515 | 4/1991 | McCormack . | |
| 5,621,299 | 4/1997 | Krall | 320/5 |
| 5,744,934 | 4/1998 | Wu | 320/111 |

FOREIGN PATENT DOCUMENTS

| | | |
|---|---|---|
| 2577390 | 8/1986 | France . |

*Primary Examiner*—Teresa Walberg
*Assistant Examiner*—Vinod D Patel
*Attorney, Agent, or Firm*—Robert L. Harrington

[57] ABSTRACT

A personal outdoor heating system that includes an electric cover that is powered by a power pack that has re-chargeable batteries. The electric cover has a defined footprint or wiring layout that is within the central portion of the cover. The footprint is selected to provide a desired comfort zone for a user(s). The power pack has a single receptacle to input power to the power pack to recharge the batteries and for output of power to the cover. Power to the cover is selectable between a high setting and a normal setting. A control module of the power pack has a recharging circuit for charging the batteries and a power circuit for supplying power to the cover.

5 Claims, 4 Drawing Sheets

FIG. 5
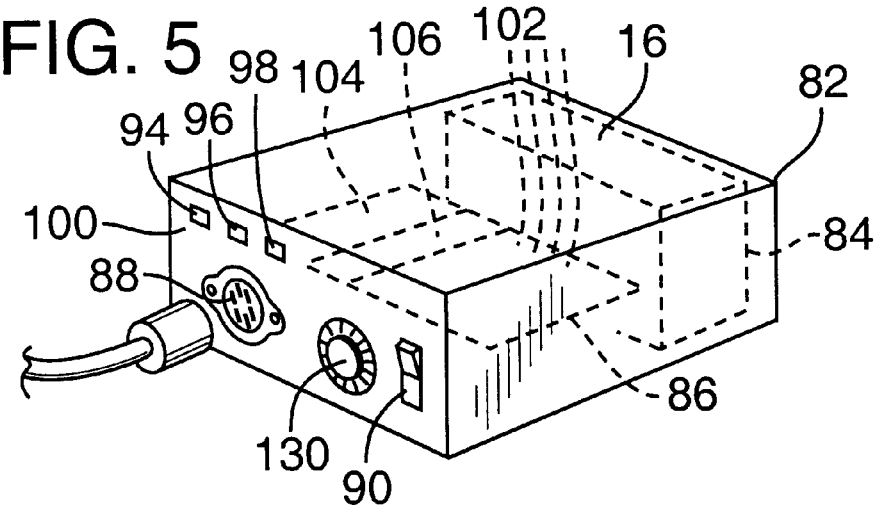
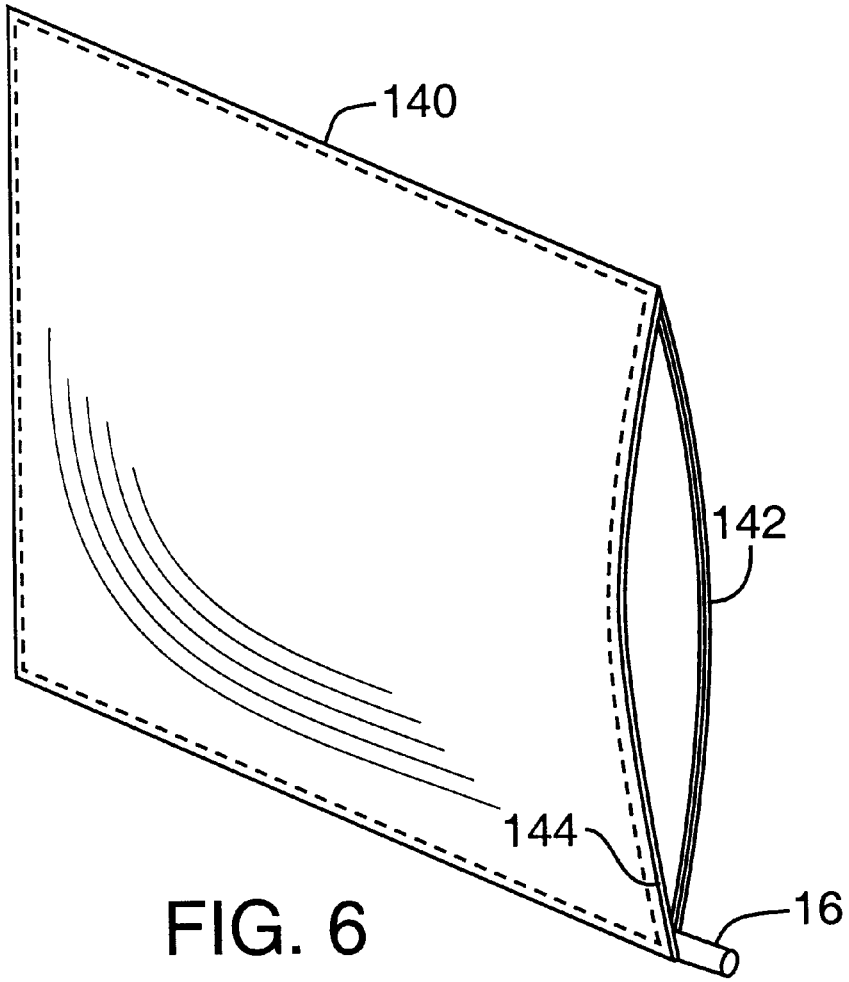
FIG. 6

OUTDOOR ELECTRIC PERSONAL HEATING SYSTEM

FIELD OF THE INVENTION

This invention relates to a heat producing cover to be used, e.g., by spectators of outdoor sporting events, the cover being heated electrically by a rechargeable battery, the design of which enables easy portability and use in inclement weather.

BACKGROUND OF THE INVENTION

Literally thousands of outdoor sporting and recreational events take place during the Autumn months of each year. High school, college and professional sporting events such as football and soccer draw millions of spectators each Autumn to outdoor stadiums. A very substantial number of these events throughout the Autumn and early Winter seasons take place in mildly bad to miserable weather conditions. Temperatures can drop to near and below freezing and wind, rain, snow and sleet add to the misery.

Spectators find some relief by wearing heavy clothing and covering up with blankets. However, spectators are relatively inactive (they may sit for upward of two to three hours) and rain and cold mixed together can penetrate through the warmest of these garments.

It is accordingly an object of the present invention to equip the spectator with a light weight case or bag e.g., like a sports duffel bag that can be easily carried into a stadium and stored under a stadium seat. Should weather conditions deteriorate, a heating cover is withdrawn from the bag, draped over the spectator as desired and controls adjusted to produce the desired warmth and protection from the elements.

Achieving the above objective is not, as one might suppose, a matter of removing one's electric blanket from its normal place on the bed, hooking up a battery and stuffing the combination into a carrying bag. Electric produced heat demands a high rate of electricity and to supply an electric blanket with enough power to last even the two to three hours for a football game would require a battery too heavy to carry.

An electric blanket is typically used in the warmth and protection of a bedroom. In an outdoor situation with temperatures near or below freezing, the heat from an electric blanket would be rapidly drawn from the exterior side of the blanket and largely reduce any benefit to the user. Further, a blanket rapidly absorbs moisture and when wet would augment rather than alleviate discomfort.

An electric blanket includes heating elements such as heating wires tacked in place between plies of cloth and not intended for the rough handling of a portable cover. Additionally, a cover as contemplated by this invention must be powered by a rechargeable battery with accident proof but convenient connection for both applying power to the cover and recharging the battery. It is preferably temperature controllable and it may be desired to provide recharging and/or heating via a vehicle cigarette lighter, e.g., on the way to a sporting event.

SUMMARY OF THE INVENTION

The preferred cover of the present invention satisfies the above objectives. The cover is sized to fully cover the lap and legs or a portion of a torso of two persons sitting together and accordingly is applicable to one or two persons. It has been determined that the heated portion of the cover need not extend to the edges and by confining the heated areas to a central portion of the cover (e.g., leaving a border or perimeter area around the cover that is unheated), the electric demand can be substantially reduced without significantly effecting the benefits. The perimeter portions are, however, essential to the cover as the perimeter portions serve to retain the heat and provide protection from the elements within the covered areas.

To further preserve the battery charge, the current flow is an interrupted flow, i.e., the current is rapidly cycled on and off (to varying degrees of on time versus off time depending on control setting). The reduced area (or wiring foot print) plus the on/off cycling enables the use of a sufficiently light battery to provide heat for the desired two to three hours, i.e., the length of a football or soccer game.

A further feature that contributes to the power preservation is the cover structure itself. The cover is provided with three plies, the exposed outside ply being relatively non-heat conductive yet heat reflective, and the exposed inside ply being heat conductive. Thus, heat is prevented from freely escaping to the atmosphere and is conducted inwardly as desired for efficient utilization of the heat generated by the heating elements. Both outside and inside plies are preferably water repellent, this being particularly important for the outside ply so as to shed rain. An absorbent fabric would quickly become a source of discomfort and render the cover of little or no value. The inner ply can also be exposed to moisture as rain water runs off of a user's jacket and down under the cover. Also, the non-absorbent characteristics of both sides of the cover facilitate cleaning and drying.

The structure of the cover also insures secure placement of the heating wires. The third ply, i.e., a center ply, is provided with a pattern depression and the heating elements (wires) are laid in the pattern. The inner ply and the center ply are then laminated together, thus securing the heating elements between the center and inner plies to insure that there is no movement of the wire elements within the cover.

The overall design of the cover system includes a power source (rechargeable battery), controls (including a control module), a fabric-like carrying case (similar to a duffel bag) and connecting cords. The power pack including battery and controls is housed in the carrying case, e.g., a bottom compartment that opens to an end or side of the case. The cover is stored in an upper portion of the case and readily removed from the case. At least three electric cords are provided. One cord connects the power pack to the cover for heating. A second cord connects the power pack to a household electrical AC current powered charger for recharging. A third cord connects the power pack to a vehicle cigarette lighter for recharging or to supply power to the cover.

The control module facilitates the use of the different functions and enables the use of a single outlet/inlet. The connectors fit different combinations of connecting prongs in the outlet/inlet to activate the different functions. Such connectors insure error free operation and the control module further provides for the control of the heating, i.e., the current flow is interrupted for varying lengths of time to increase or decrease the level of heat provided to the cover.

The numerous distinguishing features will be more fully appreciated upon reference to the following detailed description and drawings referred to therein.

DESCRIPTION OF THE DRAWINGS

FIG. 5 is a view of an alternate power pack; and

FIG. 6 is a view of a container for the cover of FIG. 1.

DESCRIPTION OF THE PREFERRED EMBODIMENT

Figure 1:
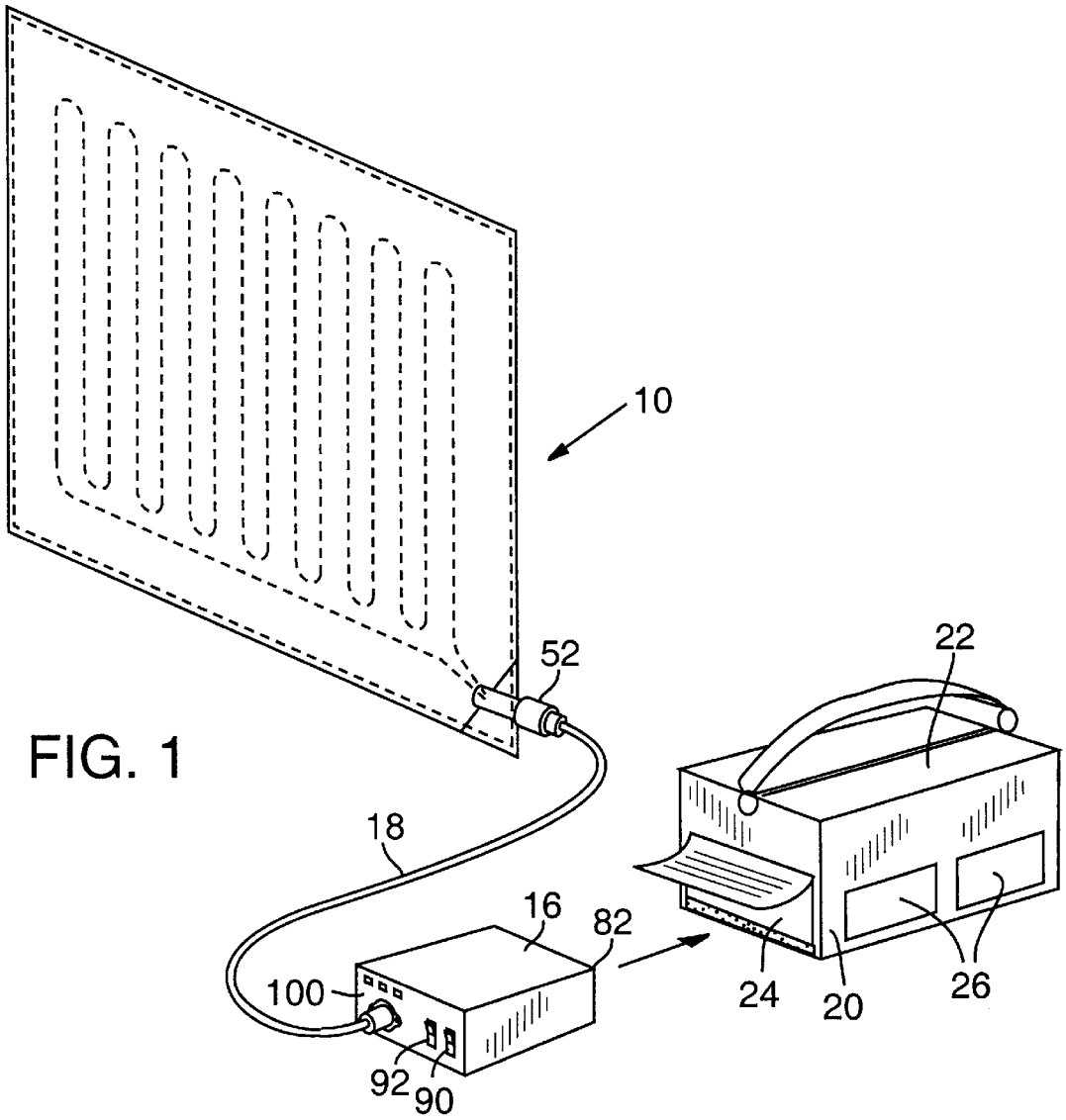
FIG. 1 is a view of a heated outdoor cover, a power pack, a cable, and a carrying case.
Figure 4:
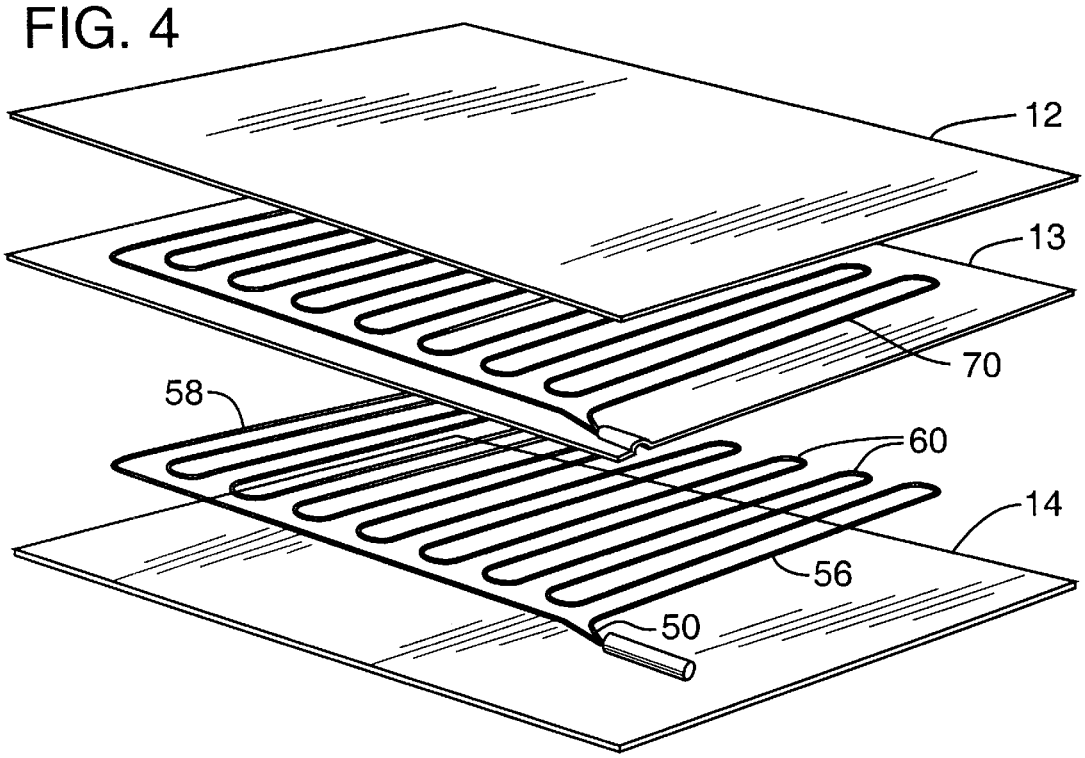
FIG. 4 is a view illustrating the construction of the cover of FIG. 1.

FIGS. 1 and 4 of the drawings illustrate a portable electric cover (blanket) 10. The cover 10 illustrated is rectangular in shape and has a waterproof outer layer 12. The inner layer 14 is of a fleece-like material. The cover 10 is powered to produce heat by a power source such as a battery 84 contained in a power pack 16. A cord 18 is provided to connect the cover 10 to the power pack 16.

A carrying case 20 is provided to transport the cover 10, the power pack 16 and the cord 18. The cover 10, when folded, fits in the upper compartment 22 of the case 20. A bottom compartment 24 is sized to house the power pack 16 and the cord 18. Additional pouches 26 are provided for storing other items of a user, such as additional cords.

Figure 2:
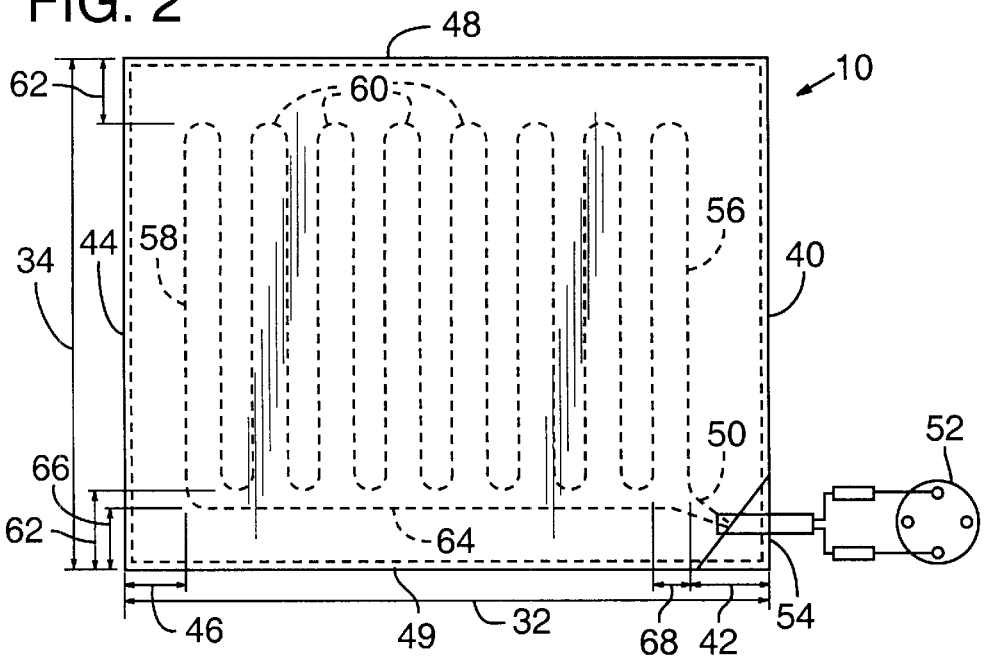
FIG. 2 is a view of one example of a wiring layout for the cover of FIG. 1.

The wiring layout (footprint) for the cover 10 is illustrated in FIG. 2. It will be appreciated that the layout may have different configurations. FIG. 2 is provided as an example of a cover 10 that may be utilized as a stadium blanket. The dimensions given are by way of example only, the reader realizing that the cover 10 may be of different sizes.

The cover 10 in this example of FIG. 2 has a length 32 of about 55 inches and a width 34 of about 39 inches. A cover 10 of these dimensions has been found to be adequate to provide cover for two individuals seated side by side. It will be appreciated that the cover 10 of FIG. 2 may also be used by a single individual.

As shown, a wire 50 is laid out in a single continuous multiple loop pattern. One end of the wire 50 extends from a plug 52 provided at a corner 54 of the cover 10 and extends along the patterned loop with the opposite end of the wire also being connected to the plug 52. The wire 50 is preferably of the TEFLON coated type. One end of the wire 50 is connected to one conductive element of the plug 52 and the other end of the wire 50 is connected to a separate conductive element of the plug 52.

The first leg 56 of the patterned loops is inset from the edge 40 at a distance 42 of about 8 inches and the last leg 58 is inset from edge 44 at a distance 46 of about 8 inches. The arcuate portions 60 of the loops are inset from the edges 48, 49 a distance 62 of about 6 inches. The wire run 64 that extends from the leg 58 to the corner 54 is at a distance 66 from the edge 49 of about 5 inches. The legs of the loops are substantially parallel one to the other and have a distance 68 between adjacent legs of about 3 inches. The footprint of the wire 50 is essentially positioned within the center portion of the cover 10 leaving a border around the perimeter in which the wire 50 is not provided. It has been found that this provides a desired comfort zone for the users, whether it be two individuals or one.

With reference to FIG. 4, the cover 10 is preferably of layered construction. The outer layer 12 is preferably of a water repellent material such as water proof oxford nylon. The inner layer 14 is preferably of a fleece-like material such as POLARTEK®. A center layer 13 of pellon like material is sandwiched between the outer layer 12 and the inner layer 14 with the center layer 13 being laminated to the inner layer 14.

The center layer 13 has a continuous groove 70 formed by a conventional stamping or pressing operation. The groove 70 conforms to the desired layout pattern of the wire 50. In this embodiment, the groove 70 conforms to the pattern of the wire layout of FIG. 2. The length of wire 50 is placed in the groove 70 and the center layer 13 and the inner layer 14 are laminated together using conventional methods. The wire 50 is in effect between the center layer 13 and the inner layer 14. The wire is thus captively held in place by the groove 70 in the center layer 13 that is capped by the inner layer 14 bonded to the center layer 13. The layer 12 and the bonded layers 13, 14 are joined together at their edges in a conventional manner such as by sewing.

The cover 10 being constructed of the preferred materials provides for a light weight cover that has an exposed outer layer 12 that is essentially waterproof and an exposed inner layer 14 that is water repellent. The inner layer 14 is essentially non-absorbent even thought it has a fleece like construction. The layer 14 will retain moisture, however it will not wick up moisture like other materials such as cotton. The cover 10 is machine washable and is readily dried by drip drying or machine drying at a low setting.

Figure 3:
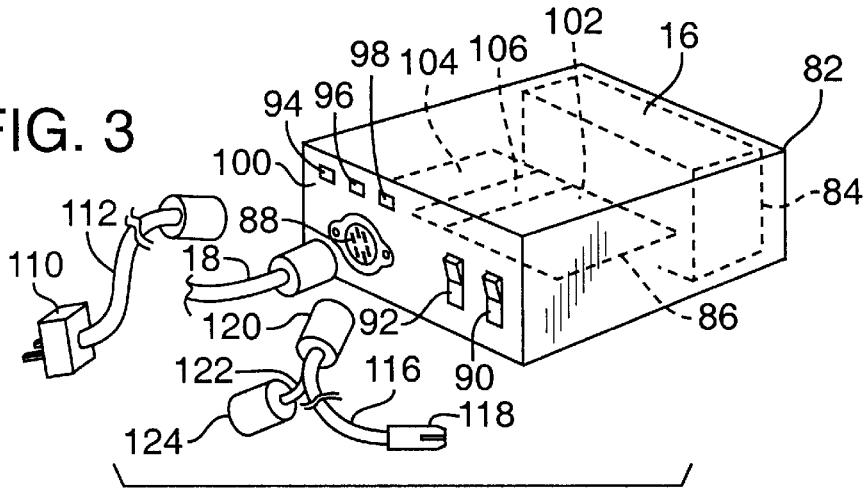
FIG. 3 is a view of the power pack of FIG. 1.

Power is supplied to the wire 50 of the cover 10 by a power pack 16 as illustrated in FIGS. 1 and 3. The power pack 16 has a chassis 82 that houses a power source such as batteries 84 and a controller 86. An electrical receptacle 88, an on/off switch 90, a power level selector switch 92 and light emitting diodes 94, 96 and 98 are mounted to a front panel 100 of the chassis 82. The receptacle 88, the switch 90, the switch 92 and the LED's are coupled to the controller 86.

The LED 98 will be illuminated when the switch 90 is turned to the on position to indicate that power is on. The LED 96 will be illuminated when the battery 84 is being recharged. The LED 94 will be illuminated when the battery 84 is at a low potential, thus indicating that the battery requires recharging.

The controller 86 has a charging circuit 102 for recharging the batteries 84 and has a power circuit 104 for supplying power to the receptacle 88 when the switch 90 is in the on mode. Charging circuits and power circuits are well known in the art and are therefore not detailed.

In this embodiment the power circuit 104 is arranged to output two power levels. The power level switch 92 selects the desired power level. The switch 92 when toggled to one position selects a high output level designated as a high heat setting. The switch 92 when toggled to the other position selects a lower output level referred to as a normal heat setting. When the switch 92 is set at the high heat setting, the full 12V of the batteries 84 is continuously applied to the load (wire 50) of the cover 10. When the switch 92 is set at the normal heat setting, the full 12V of the batteries 84 is applied to the load (wire 50) of the cover 10 at a 50 percent duty cycle. That is, the full 12V of the battery 84 is applied 50 percent of the time.

The controller 86 has a monitoring circuit 106 which will disconnect the batteries 84 from the load (wire 50) when the voltage of the batteries 84 drops below a predetermined level such as about 9.2 VDC. The monitoring circuit protects the batteries 84 from being overly discharged thereby increasing the life of the batteries.

The receptacle 88 of the power pack 16 is of the multiple socket type and is utilized to supply power to the power pack 16 and to draw power from the power pack 16. Certain of the sockets of the receptacle 88 and the corresponding pins of a mating plug are selected for power input and different sockets and their corresponding pins are selected for power output. A single receptacle 88 is thus utilized to apply various sources of power to the power pack 16 and to withdraw power from the power pack 16.

The batteries 84 are typically recharged by a known charger 110 that obtains power from a conventional 110 V AC source. A plug end of a cable 112 of the charger 110 is coupled to the receptacle 88 to input power from the charger 110 to the charging circuit 102 of the controller 86. The charging circuit 102 supplies the power input from the charger 110 to the batteries 84 to recharge the batteries.

The batteries 84 may also be recharged by another voltage source such as a battery of a vehicle. A cable 116 having a plug 118 on one end adapted to be plugged into a cigarette lighter of the vehicle and having a plug 120 on the other end that fits the receptacle 88 of the power pack 16 is provided to connect the power pack 16 to the battery of the vehicle.

A short cable 122 extends from the plug 120 and has a receptacle 124 similar to the receptacle 88. The cover 10 may be connected to the receptacle 124 by cable 18 and thus power to the cover 10 will be supplied by the battery of the vehicle via the power pack 16 without depleting the charge on the batteries 84. Power to the receptacle 124 is supplied through the power circuit 104 of the power pack 16.

The footprint of the wiring layout, such as shown in FIG. 2 is determined from desired operating parameters. The cover 10 of FIG. 2 for example is desired to have a sustained heating capacity of about three hours on the normal setting. The available source of power (batteries 84) in connection with the desired time length of applied heat determines the resistance i.e., the length of wire (wire 50) that is to be used to establish the footprint. It is recognized that a larger battery may be supplied to provide a longer sustained heat cycle, however a larger battery adds appreciably to the weight of the package. The package including the cover 10, the power pack 16, the carrying case 20 and connecting cable(s) are preferably in the weight range of about ten pounds. A package in this weight category is easily transportable over relatively long distances by an individual.

FIG. 5 illustrates a power pack 16 that has a potentiometer 130 coupled to the controller 86 to vary the power applied to the wire 50. The potentiometer 130 is infinitely variable from a low range to a full power range. In this embodiment, the low range is on the order of about 10 percent of available power.

FIG. 6 illustrates a sterilizable container 140 for encapsulating the cover 10. The container 140 is of a size to accept the cover 10 and has one side 142 that has a closure 144, such as a zipper, to seal the cover 10 within the container 140. The container 140 protects the cover 10 from contamination. A sheath 146 is provided for the plug 52. The container 140 is constructed of a disposable plastic material or of a re-usable washable sterilizable material such as nylon. The container 140 would, for example, be used to enclose the cover 10 when used for medical purposes. The container 140 after being applied to an individual would be removed from the cover 10 and the cover 10 would be placed in a new sterile container 140 before use on another.

Figure 7:
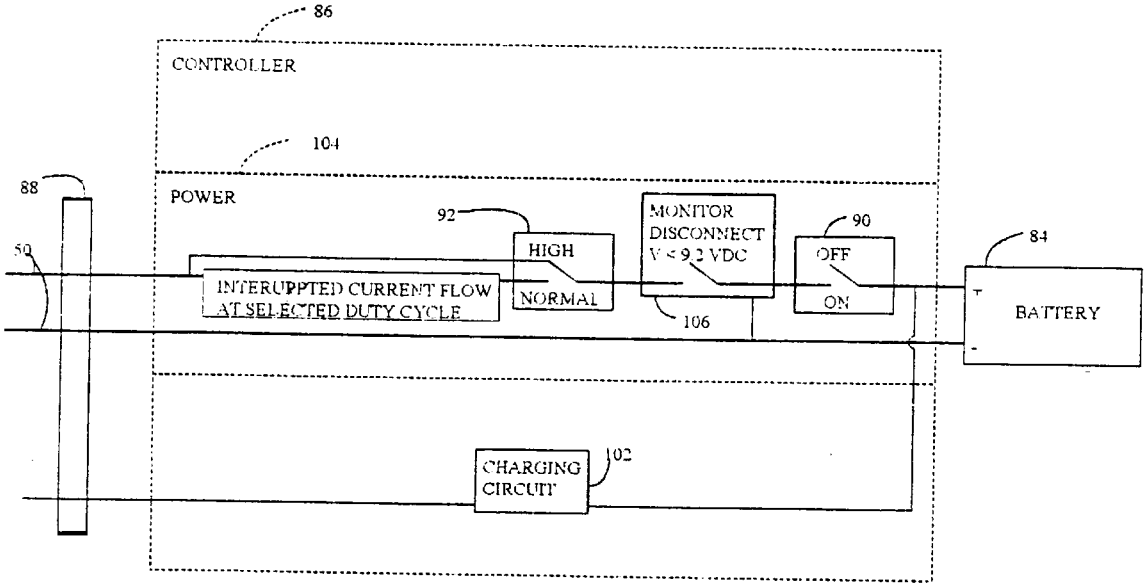
FIG. 7 is a more specific drawing of the electronic controls for the components of FIG. 1.

FIG. 7 illustrates in more detail components of power pack 16 as previously described. Battery 84 is recharged by way of charging circuit 102. (page 11, line 15) Battery 84 supplies power to receptacle 88 by way of a power circuit 104 when the on/off switch 90 is in its "on" mode. (Page 11, lines 15–17) Power circuit 104 outputs two power levels. (Page 11, line 21) Power level switch 92 toggles between a high output level heat setting and a lower output level heat setting, i.e., also referred to as normal heat setting. (Page 11, line 22–page 12, line 3) With switch 92 set at the high heat setting, the full 12 volts of battery 84 is continuously applied to the load wire 50 of cover 10. (Page 12, lines 3–5) With switch 92 in its normal heat setting, however, the full 12 volts of battery 84 is applied to load wire 50 of cover 10 at a 50% duty cycle through an interrupted current flow at a selected 50% duty cycle. (Page 12, lines 5–8) While described herein at a 50% duty cycle for the normal setting of switch 92, current flow is interrupted for varying lengths of time to increase or decrease the level of heat provided to the cover. (Page 6, lines 8–11)

The monitoring circuit 106 disconnects battery 84 from load wire 50 when the voltage of battery 84 drops below a predetermined level such as approximately 9.2 vdc. (Page 12, lines 10–13)

While not specifically illustrated in FIG. 7, it will be understood that the LED's 94, 96 and 98 are coupled as necessary to illuminate LED 98 when switch 90 is turned to the on position; illuminate LED 96 when the battery 84 is being recharged; and illuminate LED 94 when battery 84 is at a low potential. (Page 11, lines 9–12).

Those skilled in the art will recognize that modifications and variations may be made without departing from the true spirit and scope of the invention. The invention is therefore not to be limited to the embodiments described and illustrated but is to be determined from the appended claims.

I claim:

1. An electrically heated blanket for outdoor use comprising:

a blanket sized and configured to be draped over a person's torso, an electrically powered heating element embodied in said blanket, an outer boundary of said heating element defining a footprint, a light weight rechargeable battery having a limited available power output providing electrical power to said heating element and said heating element configured to draw electric power at a maximum rate no greater than what would deplete the power output of the battery over about a three-hour time period, a control for controlling electrical power flowing from said battery to said heating element, a carrying case for removably carrying the combination of blanket, battery and control and having a combined weight of no greater than about ten pounds, and electrical preservation measures preserving and extending the available power of said light weight battery comprising:

said blanket having an upper side layer and an under side layer and said heating element sandwiched between said layers, said upper side layer having a water repellent outer surface and being heat reflective, said under side layer having a water resistant outer surface and being heat conductive;

said blanket defining a peripheral edge and said peripheral edge defining a covered area, and said layers both extended to said peripheral edge to provide consistent heat retention throughout said covered area, said heating element spaced inwardly from said peripheral edge whereby the footprint covers an area at least ten percent less than the covered area, said ten percent defining an edge portion, and said control providing adjustable power from said battery to said heating element, and an extended electrical connection between said battery and said heating element to enable the battery to be floor supported in said carrying case with the blanket removed from the carrying case and draped across the person's torso;

said blanket of sufficient size that opposed side edge portions of the blanket extend beyond the torso as draped over the torso to provide retention of the heat generated by said heating element.

2. A heating system as defined in claim 1 wherein the over cover includes a center layer sandwiched between the inside layer and outside layer, said center layer provided with a patterned groove that faces the inside layer and said heating element being a heating wire laid in the groove, said center layer and inside layer laminated together to secure the heating wire in the patterned groove.

3. A heating system as defined in claim 1 wherein said carrying case is provided with a first compartment housing the control, and a second compartment for storing the cover.

4. A heating system as defined in claim 1 wherein current flow to the heating element is a selectively interrupted current flow controlled by said control.

5. A heating system as defined in claim 1 including a second electrical connector and control therefore for connecting the rechargeable battery to household AC current for recharging and a third electrical connector and control therefore for connecting the rechargeable battery to a car battery for recharging.

* * * * *